US010046223B2

(12) United States Patent
Bartron

(10) Patent No.: US 10,046,223 B2
(45) Date of Patent: Aug. 14, 2018

(54) ENERGY ABSORBING PUNCHING BAG MOUNTING APPARATUS

(71) Applicant: Firstlaw Fitness, Coopersburg, PA (US)

(72) Inventor: Jeff Bartron, Coopersburg, PA (US)

(73) Assignee: Firstlaw Fitness, LLC, Coopersburg, PA (US)

( * ) Notice: Subject to any disclaimer, the term of this patent is extended or adjusted under 35 U.S.C. 154(b) by 0 days.

(21) Appl. No.: 15/157,822

(22) Filed: May 18, 2016

(65) Prior Publication Data

US 2017/0333774 A1 Nov. 23, 2017

(51) Int. Cl.

| | |
|---|---|
| ***A63B 69/22*** | (2006.01) |
| ***A63B 69/24*** | (2006.01) |
| ***A63B 69/20*** | (2006.01) |
| ***A63B 71/02*** | (2006.01) |

(52) U.S. Cl.
CPC ..... *A63B 69/201* (2013.01); *A63B 69/24* (2013.01); *A63B 71/023* (2013.01)

(58) Field of Classification Search
CPC ..... A63B 69/201; A63B 69/20; A63B 69/203; A63B 69/205; A63B 69/24; A63B 5/08; Y10T 403/45; Y10T 403/459
See application file for complete search history.

(56) References Cited

U.S. PATENT DOCUMENTS

| | | | | |
|---|---|---|---|---|
| 3,497,216 | A * | 2/1970 | Feather | A63B 21/00043 482/122 |
| 4,721,302 | A | 1/1988 | Murphy | |
| 7,645,221 | B1 * | 1/2010 | Curry | A63B 21/023 482/142 |
| 8,342,475 | B2 * | 1/2013 | Tsakiris | A63B 69/201 248/343 |
| 8,540,314 | B2 * | 9/2013 | Fernandez | A47C 3/30 297/314 |
| 9,597,250 | B2 * | 3/2017 | Simeone | A63B 69/0064 |
| 2002/0151387 | A1 * | 10/2002 | Henson | A63B 63/00 473/446 |
| 2006/0035733 | A1 * | 2/2006 | Silver | A63B 69/408 473/438 |
| 2014/0106940 | A1 * | 4/2014 | Zimmerman | F16M 11/14 482/86 |
| 2015/0352423 | A1 * | 12/2015 | Almeras | A63B 69/201 482/89 |
| 2016/0175654 | A1 * | 6/2016 | Harwin | A63B 26/003 482/142 |

* cited by examiner

*Primary Examiner* — Loan H Thanh
*Assistant Examiner* — Megan Anderson
(74) *Attorney, Agent, or Firm* — Muskin and Farmer LLC

(57) ABSTRACT

A punching bag mount which reduces trauma on the structure which the mount is attached to. A punching bag is attached to a connector on the mount which is typically repeatedly punched. The mount utilizes springs and flexible strips arranged in a radial pattern in order to absorb the energy of the blows, thereby reducing the amount of energy transferred to the structure. The mount would typically mount into floor beams of the floor above the room in which the mount and punching bag is installed.

22 Claims, 9 Drawing Sheets

FIG. 6
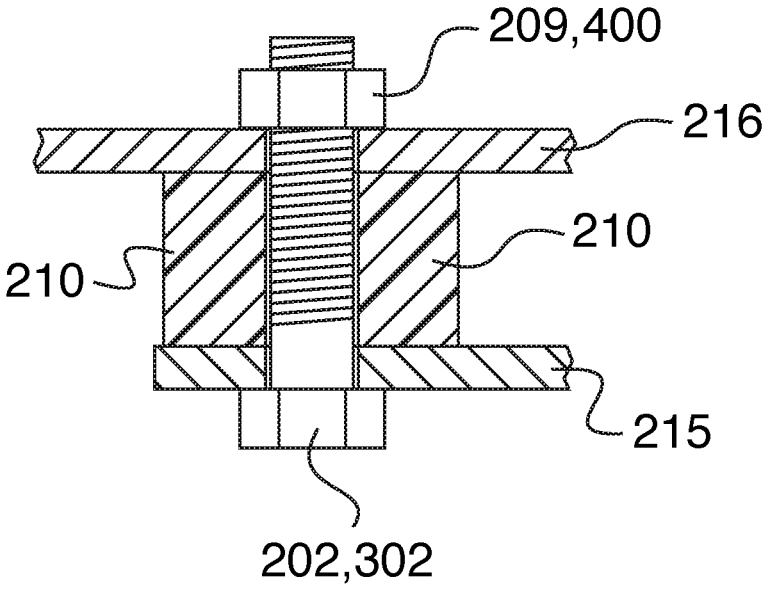
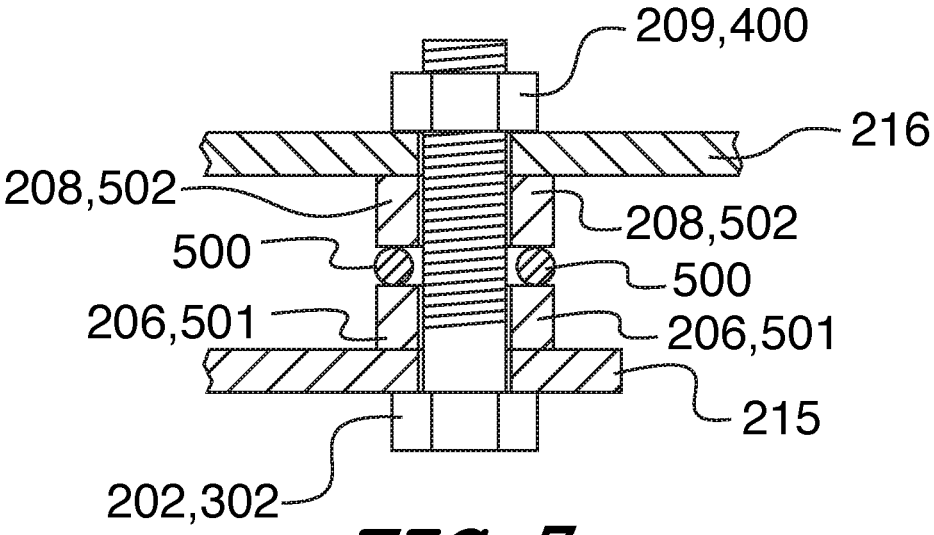
FIG. 7

ENERGY ABSORBING PUNCHING BAG MOUNTING APPARATUS

BACKGROUND OF THE INVENTION

Field of the Invention

The present general inventive concept is directed to a method and apparatus directed to mounting a punching bag or related exercise equipment.

Description of the Related Art:

Punching bag mounts are used to mount a punching bag to a ceiling in a structure. One problem with such mounts is that due to the repeated blows on the bag when it is being used for exercise, such vibrations can cause trauma and ultimately damage to the structure.

What is needed is a mechanism which can enable a punching bag its full functionality but reduce the amount of trauma on the surrounding structure.

SUMMARY OF THE INVENTION

It is an aspect of the present invention to provide an improved mounting mechanism and apparatus.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 6 is an enlarged view of a bolt passing through a respective strip, according to an embodiment; and FIG. 7 is an enlarged view of a bolt passing through a lower spacer, a respective spring hook, and an upper spacer, according to an embodiment;

DESCRIPTION OF THE PREFERRED EMBODIMENTS

Figure 1:
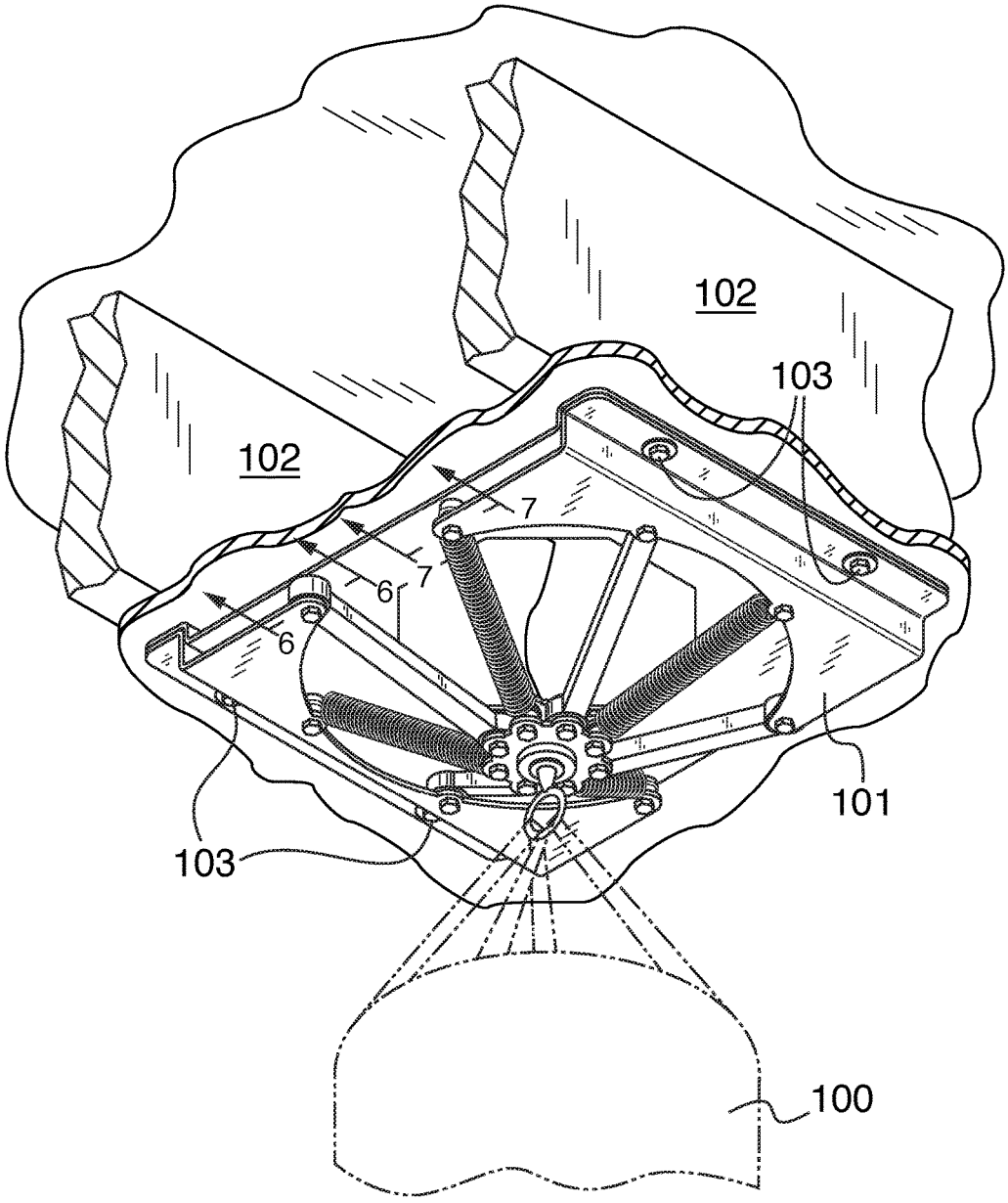
FIG. 1 is a drawing of a punching bag mount installed on a ceiling, according to an embodiment.

Reference will now be made in detail to the presently preferred embodiments of the invention, examples of which are illustrated in the accompanying drawings, wherein like reference numerals refer to like elements throughout.

The present inventive concept relates to a mount for a punching bag designed to reduce the vibrations and trauma on the structure the punching bag is mounted on. The mount serves to absorb energy thereby reducing the energy that is transferred to the structure that the mount is attached to.

FIG. 1 is a drawing of a punching bag mount installed on a ceiling, according to an embodiment.

A punching bag is connected to a ceiling by a mount 101. The mount 101 is attached to floor beams 102 (of the higher level) via screws (and optional washers) 103 screwed into the floor beams 102. As illustrated, the mount 101 is fixed onto the ceiling and a punching bag 100 is hung therefrom. The mount 101 allows full use of the punching bag (allowing the punching bag freedom of motion) but absorbs energy (blows) inflicted onto the punching bag thereby reducing vibration (and trauma) on the ceiling (and walls).

Note that in FIG. 6, the plane designated by the two arrows marked '6' is illustrated in FIG. 6, and the plane designated by the two arrows marked '7' is illustrated in FIG. 7.

Figure 2A:
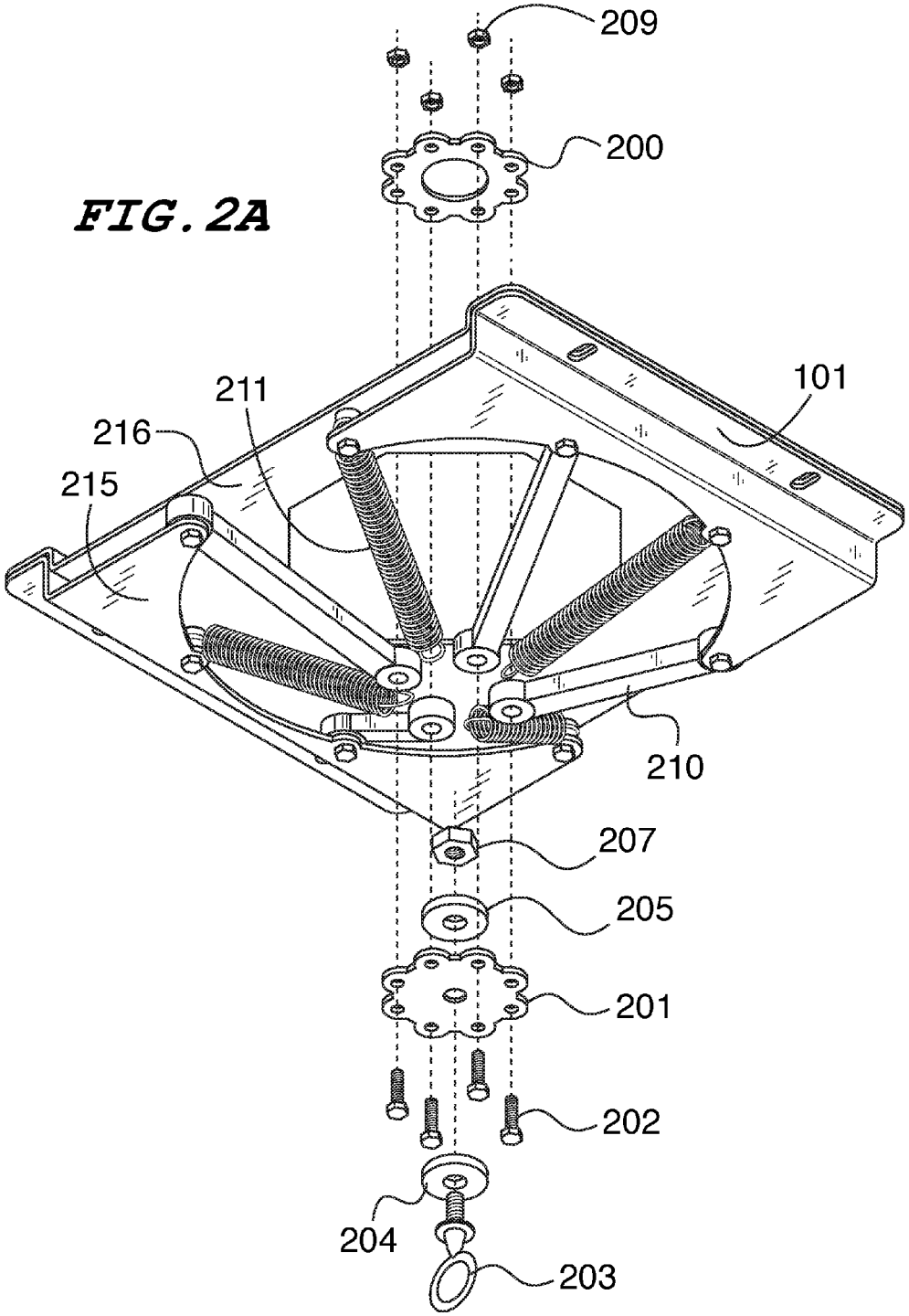
FIGS. 2A and 2B are drawings of the punching bag mount and how its parts are assembled according to an embodiment.
Figure 2B:
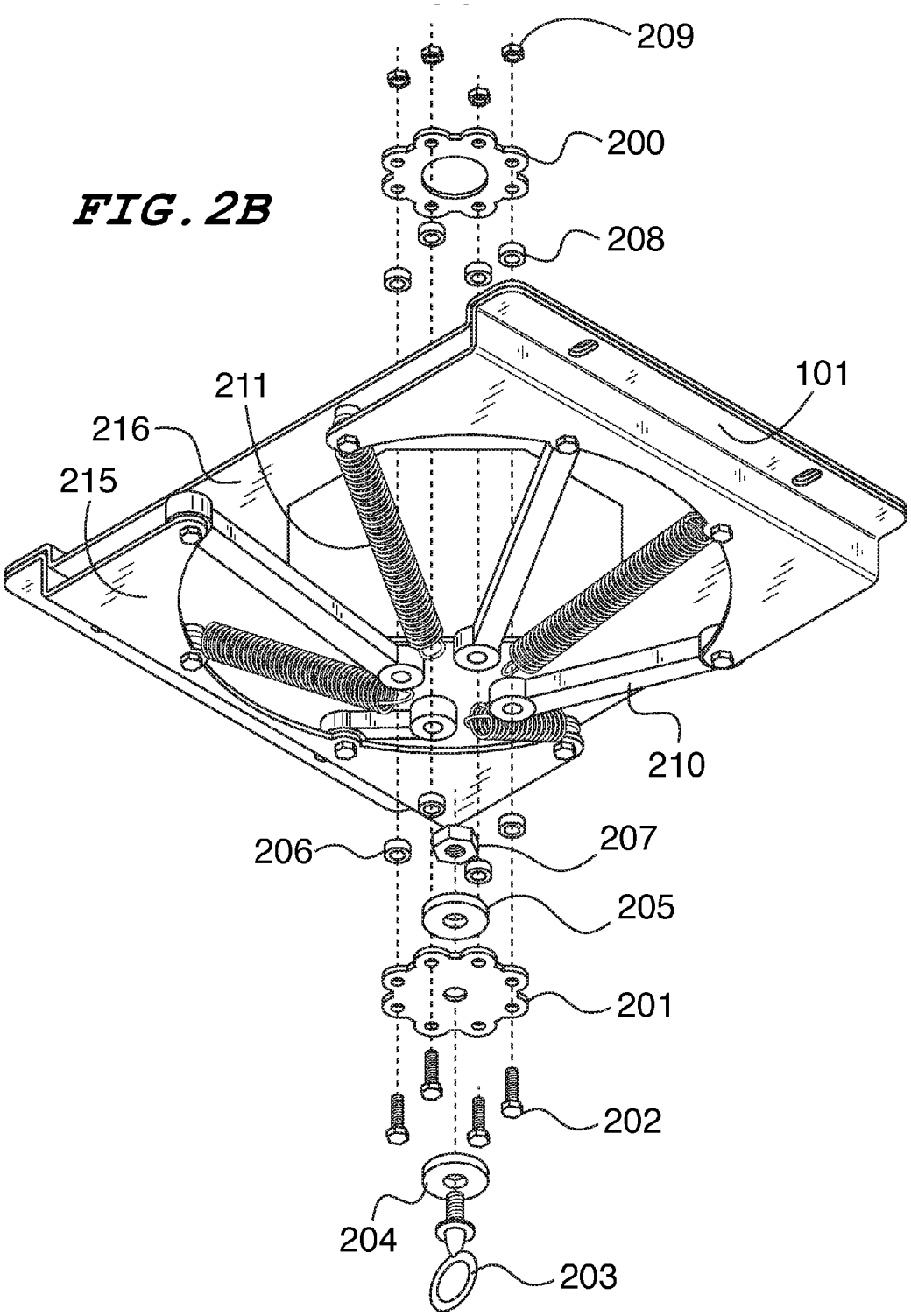

FIGS. 2A and 2B are drawings of the punching bad mount and how its parts are assembled, according to an embodiment.

The mount 101 comprises numerous parts including a frame. The frame can comprise a lower frame 215 that is attached to an upper frame 216.

An eye bolt 203 passes through a lower eye washer 204, a lower plate 201, an upper eye washer 205, and is screwed onto an eye nut 207. The eye bolt is configured to rotate when the mount is assembled. Instead of the eye bolt 203, any other connector can be used as well (e.g., hook, loop, etc.)

The mount 101 comprises four springs 211 and four strips 210, although it can be appreciated that other numbers of springs and/or strips can be used as well. Typically the springs and strips should alternate, but this is not required. While equal numbers of strips and springs are shown (four of each), in other embodiments equal numbers of strips and springs are not required (e.g., three strips and five springs, five strips and three springs, etc.)

Figure 5:
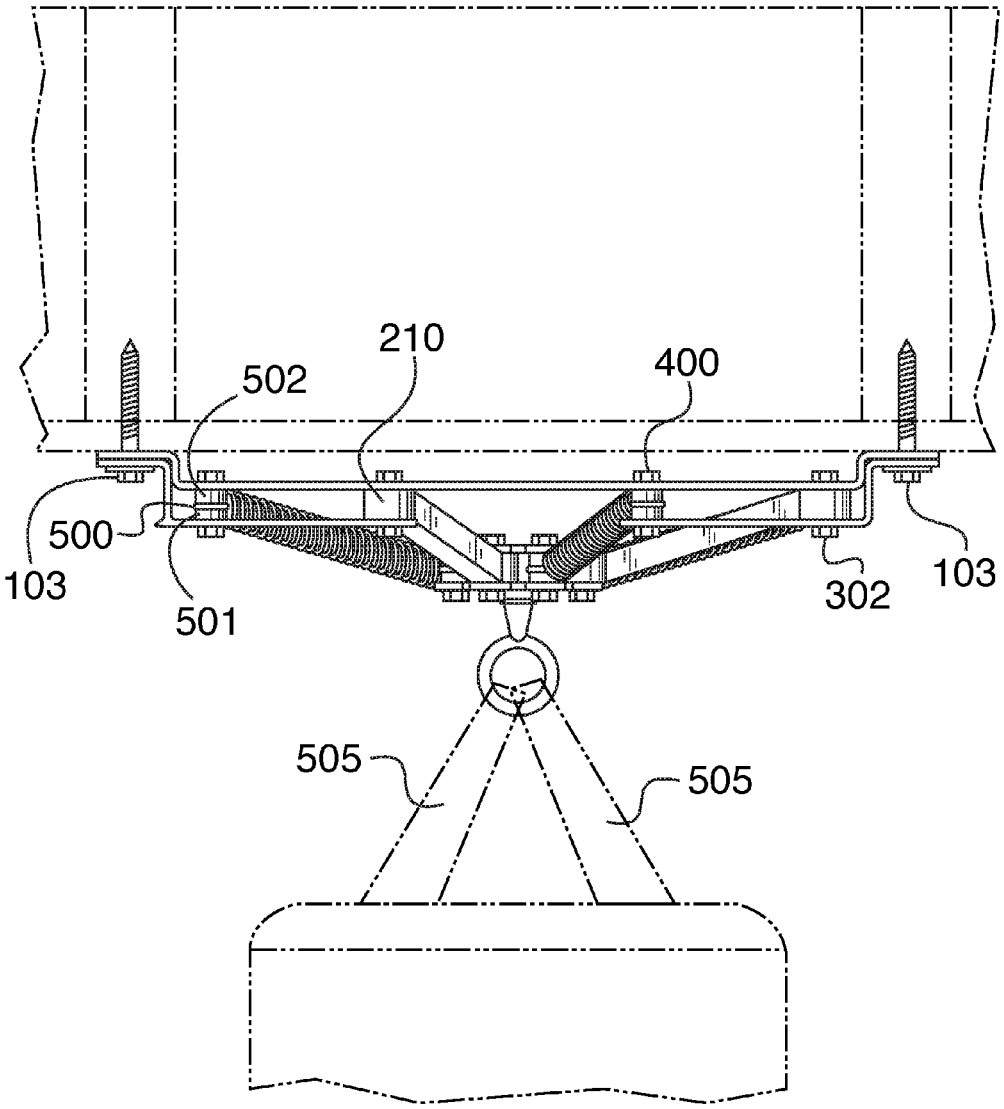
FIG. 5 is a drawing of a side of the punching bag mount, according to an embodiment.

A set of eight inner bolts 202 pass through respective holes in the lower plate 201. Four of these eight inner bolts 202 then pass through inner lower spacers 206, through a spring hook (for its respective spring), through inner upper spacers 208, through an upper plate 200 and through respective inner nuts 209 which are tightened (when assembled) against the upper plate 200. The other four of the eight inner bolts 202, after passing through respective holes in the lower plate 201, then pass through a hole in its respective strip, then through respective holes in the upper plate 200 and then through respective inner nuts 209 which are tightened (when assembled) against the upper plate 200. The lower spacers, spring hooks and upper spacers, are illustrated in FIGS. 5 and 7.

Figure 3:
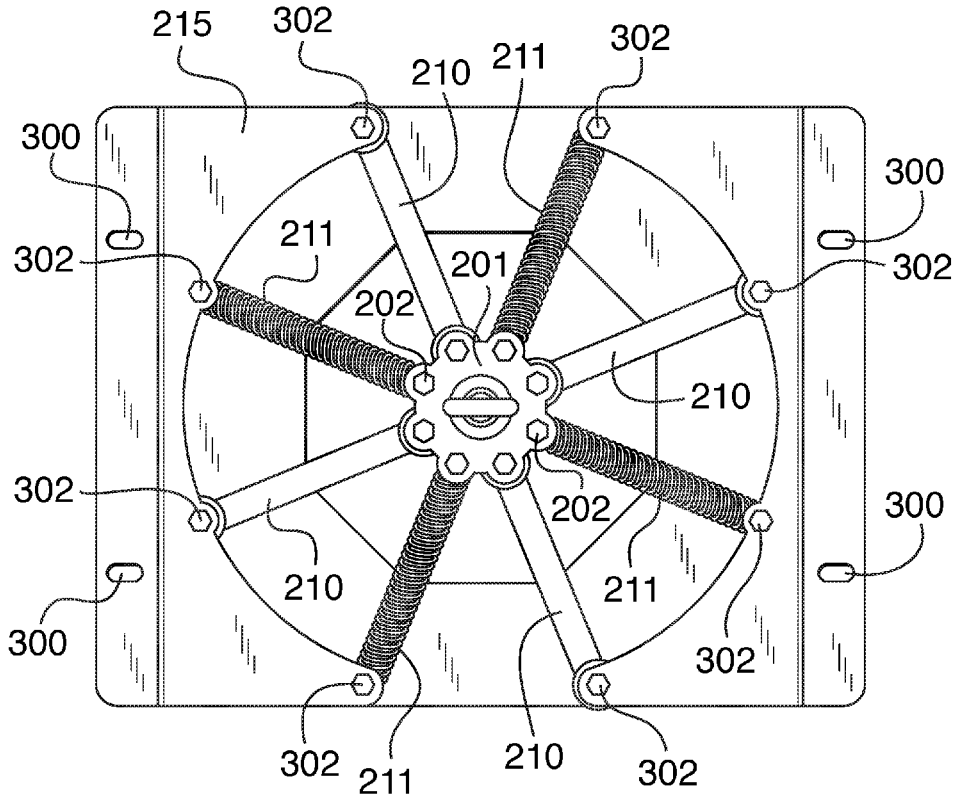
FIG. 3 is a drawing of a front of the punching bag mount, according to an embodiment.

FIG. 3 is a drawing of a front of the punching bag mount, according to an embodiment. The front is the view as if it were mounted on a ceiling and one were looking straight up at it. In this view the lower frame 215 is visible.

Mounting holes 300 are shown which enable screws 103 to pass through to attach into the floor beams 102. Shown are also the inner bolts 202 passing through the lower plate 201. Shown are also four strips 210 and four springs 211. Note that the springs 211 are typical springs (coil springs) as known in the art. The strips 210 can be made of bungee, plastic, nylon, or any flexible solid material which can flex (expand) but remain firm. The strips 210 can be made from EPDM (Ethylene Propylene Diene Monomer), which is available from numerous sources including a company Universal Polymer & Rubber LTD (in Ohio), sold under the name Tarp Straps. In one embodiment, the strips can be 4 inches long (at rest) and can have a maximum expansion of 600%, or in a range of 300% to 900% (although in another embodiment other values outside of this range can be used) of its original length. The strips can be 0.75 inches wide (although they are not required to be this wide) and have a tensile strength of 500 to 2500 PSI (although in other embodiments strengths outside of this range can be used). The strips 210 (also be referred to as flexible strips) can flex (stretch) a little but still can support a solid weight due to the material they are constructed from.

Eight outer bolts 302 pass through the lower frame 215. Four of the eight outer bolts 302 then pass through a respective hole in a strip and then through the upper plate and then tightened with an outer nut (see FIG. 5). The other four of the eight outer bolts 302 then each pass through a respective outer lower spacer, then through a spring hook for its respective spring, then pass through a respective outer upper spacer, then through the upper plate and then tightened through a respective outer nut.

Figure 4:
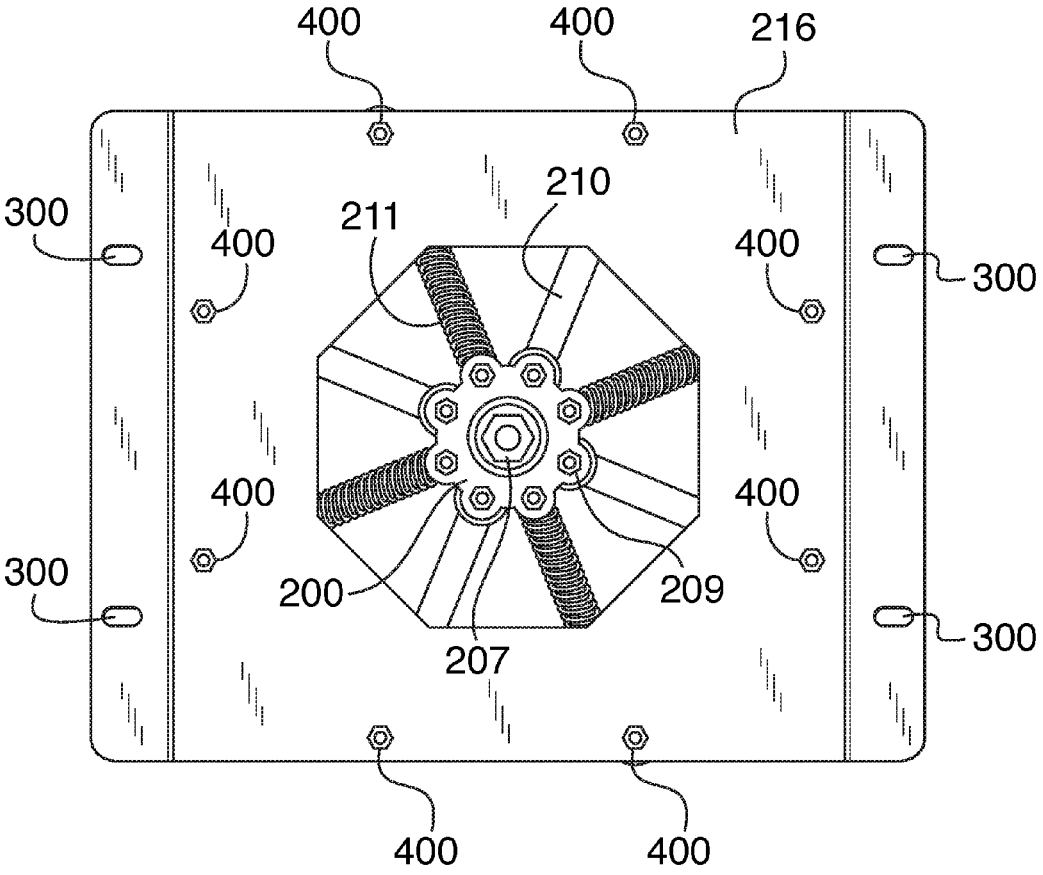
FIG. 4 is a drawing of a rear of the punching bag mount, according to an embodiment.

FIG. 4 is a drawing of a rear of the punching bag mount, according to an embodiment. This view is opposite to the view illustrated in FIG. 3 and is what one would see if looking down from above on an installed mount.

Eight outer nuts 400 are shown which are tightened against the upper frame 216.

FIG. 5 is a drawing of a side of the punching bag mount, according to an embodiment.

Outer bolts 302 are shown. Four of the outer bolts 302 pass through the lower plate, then through a respective outer lower spacer 501, a hook 500 for a respective spring, a respective outer upper spacer 502, the upper plate, and then tightened on a respective outer nut 400. The other four outer bolts 302 pass through the lower plate, then through a hole on the respective strip and then through the upper plate and then tightened on a respective outer nut 400.

Note that the outer bolts 302 are all arranged radially around the connector (which can be the eye bolt 203). This means that that the outer bolts (and hence the outer connections of the springs and the flexible strips) are arranged in a configuration which surrounds the center (where the eye bolt 203 can be located). Note that the springs and flexible strips can be equally spaced apart, although this is not required.

From FIG. 5 it can be appreciated how the apparatus operates. The punching bag is installed by securing straps 505 connected to the punching bag through the eye bolt 203. When installed as such, the weight of the punching bag will cause the upper plate 200 and the lower plate 201 to sink lower (supported by both the springs and the strips). The weight of a typical punching bag may cause the upper plate and lower plate to sink approximately one to five inches lower than if no weight were present. The strips are typically less expansive than the springs and help prevent the upper plate 200 and lower plate 201 from sinking too low (if the strips were all replaced by springs then the upper plate 200 and lower plate 201 would sink lower). When the punching bag is impacted, the springs and strips allow for some expansion and motion, thus absorbing some impact energy and also encouraging the punching bag to sway. The eye bolt is able to rotate and hence the punching bag can also rotate (if such a rotational force is present). The strips are more rigid than the springs and thus help prevent the springs from expanding too much (and hence becoming deformed and less usable).

In this manner, athletic use of the punching bag (e.g., punching it with repeated hard blows) would cause the springs and strips to absorb much of the energy thereby removing some of the trauma on the ceiling and surrounding structure. Overall vibrations and noise of the surrounding structure can also be reduced. In general, the load (weight) is supported by the springs (coil springs) and the motion is resisted by the strips. If only springs were used, then there would be too much up and down motion for a long duration. If only strips were used, then they would stretch, deform, and possibly fail over time.

FIG. 6 is an enlarged view of a bolt passing through a respective strip, according to an embodiment. FIG. 6 is a section plane which corresponds to the '6's marked in FIG. 1.

Note that while FIG. 6 shows the strip 210 between the lower frame 215 and the upper frame 216, it would be configured the same for the strip 210 between the upper plate 200 and lower plate 201 (both not pictured in FIG. 6).

The inner nuts 200 and outer nuts 400 are typically identical. The inner bolts 202 and outer bolts 302 are typically identical. Each strip 210 has two holes, one on each end. Each hole is identical and thus FIG. 6 illustrates what both holes would look like.

FIG. 7 is an enlarged view of a bolt passing through a lower spacer, a respective spring hook, and an upper spacer, according to an embodiment. FIG. 7 is a section plane which corresponds to the '7's marked in FIG. 1.

Note that while FIG. 7 shows the spring hook 500 between the lower frame 215 and the upper frame 216, it would be configured the same for the spring hook between the upper plate 200 and lower plate 201 (both not pictured in FIG. 6).

The inner upper spacers 208 and outer upper spacers 502 are typically identical. The inner lower spacers 206 and the outer lower spacers 501 are typically identical. The hook 500 is wedged between the upper spacer (whether inner upper spacer or outer upper spacer) and the lower spacer (whether inner lower spacer or outer lower spacer). The hook 500 is hooked onto the bolt (whether it is an inner bolt or an outer bolt) and spring tension keeps the hook onto the bolt (because the spring is stretched in order to hook onto both the inner bolt and the outer bolt). All of the spacers can be made of any solid material, such as plastic, nylon, PVC, rubber, Styrofoam, etc. The spacers are tightly packed inside the upper plate and the lower plate thus securing the hook 500 therebetween.

Figure 8:
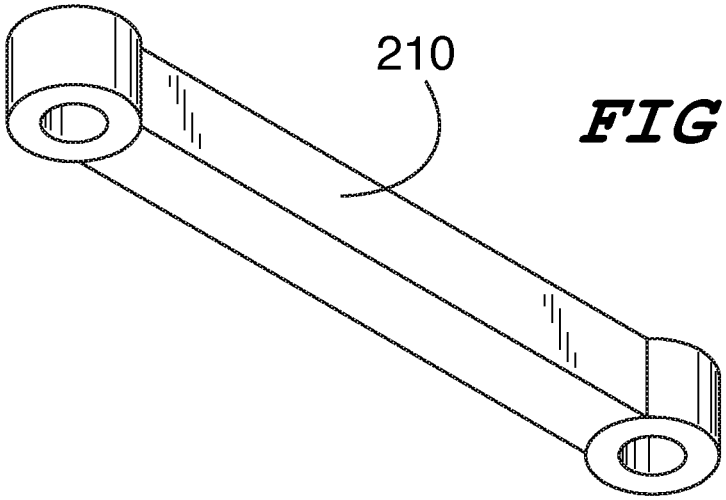
FIG. 8 is an enlarged view of a strip, according to an embodiment.

FIG. 8 is an enlarged view of a strip, according to an embodiment.

Note that on the end of each strip 210 is a hole. The opposite side of the strip 210 (not shown in FIG. 8) is identical to the side shown in FIG. 8.

Figure 9:
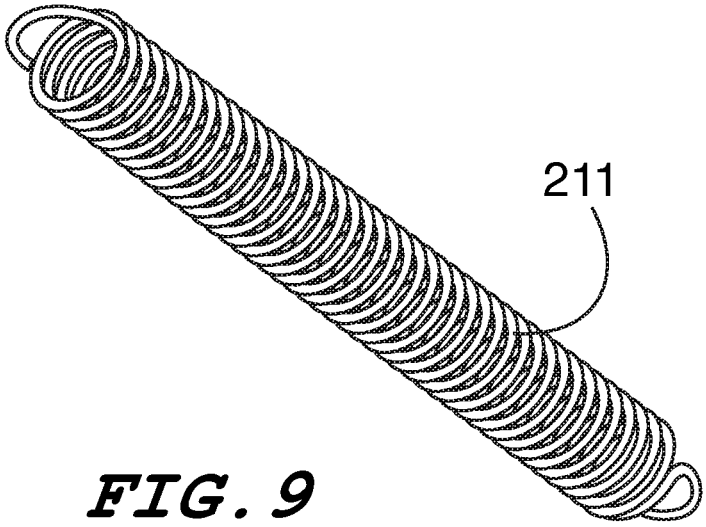
FIG. 9 is an enlarged view of a spring, according to an embodiment.

FIG. 9 is an enlarged view of a spring, according to an embodiment.

On each end of the spring 211 is the spring hook.

Figure 10:
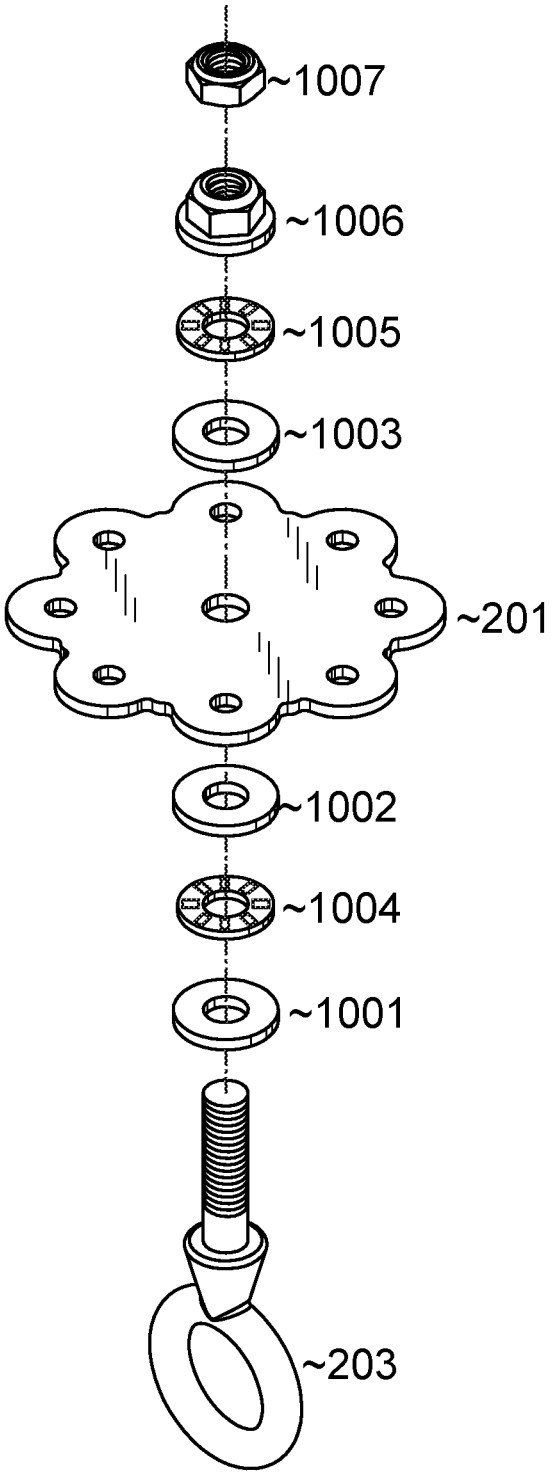
FIG. 10 is a drawing of an alternate construction of an eye bolt assembly, according to an embodiment.

FIG. 10 is a drawing of an alternate construction of an eye bolt assembly, according to an embodiment.

FIG. 2A shows an eye-bolt assembly which attaches to the lower plate 201. FIG. 10 shows an alternate eye-bolt assembly that can be used in place of the one shown in FIG. 2A. In the alternative eye-bolt assembly, the eye-bolt 203 passes through a first washer 1001, then a lower thrust bearing 1004, then a second washer 1002, then the lower plate 201, then a third washer 1003, then an upper thrust bearing 1005, then a flanged lock nut 1006 and then a jam lock nut 1007. The parts in the alternate assembly (as in the original assembly illustrated in FIG. 2A) are fitted and screwed together tightly. In this assembly (like the assembly illustrated in FIG. 2A), the eye bolt 203 can rotate freely (without becoming unscrewed). The thrust bearings 1004, 1005 are bearings that permit rotation.

In addition to being used to mount a punching bag, the apparatus as recited herein can also be used to mount any related exercise equipment (e.g., hanging mats, heavy bags, etc.)

The word "connected" or "attached" as used herein can mean a direct connection or an indirect connection through additional pieces. All parts, in their assembled positions, should be connected appropriately (e.g., all nuts tightened around screws, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A mounting apparatus for exercise equipment, comprising:

at least one spring comprising a first end and an opposite second end;

at least one flexible strip comprising a first end and an opposite second end;

a lower plate connected to the first end of the at least one spring, the lower plate also connected to the first end of the at least one flexible strip;

a frame connected to the opposite second end of the at least one spring, the frame also connected to the opposite second end of the at least one flexible strip; and a connector connected to the lower plate and extending below the lower plate, the connector configured to attach exercise equipment to the mounting apparatus.

2. The mounting apparatus for exercise equipment as recited in claim 1, wherein the first end of the at least one spring is hooked onto a respective bolt which passes through the lower plate.

3. The mounting apparatus for exercise equipment as recited in claim 2, further comprising an upper plate which the respective bolt passes though, the first end of the at least one spring being between the upper plate and the lower plate.

4. The mounting apparatus for exercise equipment as recited in claim 3, further comprising an upper spacer between the upper plate and the first end of the at least one spring and a lower spacer between the lower plate and the first end of the at least one spring.

5. The mounting apparatus for exercise equipment as recited in claim 1, wherein the at least one spring comprises at least two springs, and the at least one flexible strip comprises at least two flexible strips.

6. The mounting apparatus for exercise equipment as recited in claim 5, wherein each of the at least two springs alternates between each of the at least two flexible strips.

7. The mounting apparatus for exercise equipment as recited in claim 1, wherein the at least one flexible strip is made of ethylene propylene diene monomer.

8. The mounting apparatus for exercise equipment as recited in claim 1, wherein the at least one spring is made of steel.

9. The mounting apparatus for exercise equipment as recited in claim 1, further comprising an upper plate connected to the first end of the at least one spring, the upper plate also connected to the first end of the at least one flexible strip.

10. The mounting apparatus for exercise equipment as recited in claim 1, wherein the at least one flexible strip comprises a hole at the first end of the at least one flexible strip and a hole at the opposite second end of the at least one flexible strip.

11. The mounting apparatus for exercise equipment as recited in claim 1, wherein the connector is configured to rotate.

12. The mounting apparatus for exercise equipment as recited in claim 1, wherein the at least one spring and the at least one flexible strip are configured to bend when the exercise equipment is applied to the connector.

13. The mounting apparatus for exercise equipment as recited in claim 1, wherein the exercise equipment is a punching bag which is connected to the connector.

14. The mounting apparatus for exercise equipment as recited in claim 1, wherein the at least one flexible strip is made of nylon.

15. A mounting apparatus for exercise equipment, comprising:

a lower plate;

a first spring comprising a first end of the first spring and a second end of the first spring opposite the first end of the first spring;

a first flexible strip comprising a first end of the first flexible strip and a second end of the first flexible strip opposite the first end of the first flexible strip;

a second spring comprising a first end of the second spring and a second end of the second spring opposite the first end of the second spring;

a second flexible strip comprising a first end of the second flexible strip and a second end of the second flexible strip opposite the first end of the second flexible strip;

the first end of the first spring connected to the lower plate, the first end of the second spring connected to the lower plate, the first end of the first flexible strip connected to the lower plate, and the first end of the second flexible strip connected to the lower plate;

a frame;

the second end of the first spring connected to the frame, the second end of the second spring connected to the frame, the second end of the first flexible strip connected to the frame, and the second end of the second flexible strip connected to the frame; and a connector connected to the lower plate, the connector extending below the lower plate and configured to attach exercise equipment to the mounting apparatus.

16. The mounting apparatus for exercise equipment as recited in claim 15, wherein the second end of the first spring, the second end of the second spring, the second end of the first flexible strip, and the second end of the second flexible strip are arranged radially around the lower plate.

17. The mounting apparatus for exercise equipment as recited in claim 16, wherein the first spring and second spring and first flexible strip and second flexible strip are all equally spaced apart.

18. The mounting apparatus for exercise equipment as recited in claim 15, wherein the first flexible strip and the second flexible strip are made out of bungee.

19. The mounting apparatus for exercise equipment as recited in claim 15, wherein the first flexible strip and the second flexible strip are made out of nylon.

20. The mounting apparatus for exercise equipment as recited in claim 15, wherein the first flexible strip is made of ethylene propylene diene monomer.

21. A mounting apparatus for exercise equipment, comprising:

at least one spring comprising a first end and an opposite second end;

at least one flexible strip comprising a first end and an opposite second end;

a lower plate connected to the first end of the at least one spring, the lower plate also connected to the first end of the at least one flexible strip;

a frame connected to the opposite second end of the at least one spring, the frame also connected to the opposite second end of the at least one flexible strip;

a connector connected to the lower plate, wherein the first end of the at least one spring is hooked onto a respective bolt which passes through the lower plate; and an upper plate which the respective bolt passes though, the first end of the at least one spring being between the upper plate and the lower plate.

22. A mounting apparatus for exercise equipment, comprising:

at least one spring comprising a first end and an opposite second end;

at least one flexible strip comprising a first end and an opposite second end;

a lower plate connected to the first end of the at least one spring, the lower plate also connected to the first end of the at least one flexible strip;

a frame connected to the opposite second end of the at least one spring, the frame also connected to the opposite second end of the at least one flexible strip;

a connector connected to the lower plate; and a punching bag connected to the connector.

* * * * *